US007300477B2

(12) United States Patent
Brennan et al.

(10) Patent No.: US 7,300,477 B2
(45) Date of Patent: Nov. 27, 2007

(54) METHOD AND FUEL ADDITIVE INCLUDING IRON NAPHTHENATE

(75) Inventors: Timothy J. Brennan, Glen Allen, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 425 days.

(21) Appl. No.: 10/640,986

(22) Filed: Aug. 14, 2003

(65) Prior Publication Data

US 2005/0034359 A1 Feb. 17, 2005

(51) Int. Cl.
*C10L 1/18* (2006.01)
*C10L 1/24* (2006.01)
*C10L 1/30* (2006.01)

(52) U.S. Cl. ..... 44/358; 44/362; 44/363

(58) Field of Classification Search ..... 44/358, 44/363, 362

See application file for complete search history.

(56) References Cited

U.S. PATENT DOCUMENTS 3,332,755 A * 7/1967 Kukin ..... 44/603

FOREIGN PATENT DOCUMENTS

| | | | |
|---|---|---|---|
| CA | 1 188 891 | A1 | 6/1985 |
| EP | 0 078 249 | A | 5/1983 |
| EP | 1 344 811 | A | 9/2003 |
| FR | 2 181 607 | A | 12/1973 |
| FR | 2181607 | * | 12/1973 |
| GB | 2 091 291 | A | 7/1982 |
| WO | WO 87/00193 | A | 1/1987 |
| WO | WO 97/28358 | A | 8/1997 |
| WO | WO 99/36488 | A | 7/1999 |
| WO | WO0188362 | * | 11/2001 |

OTHER PUBLICATIONS www.oilchem.com.au/solvent_equivalents.htm Mar. 30, 2001.*
SOLVESSO 150, product data sheet; Mar. 1, 2002.*
"The Merck Index" 1996, Merck Res. Laboratories Division of Merck & Co., Inc., p. 903, col. 1, paragraph 2.

* cited by examiner

*Primary Examiner*—Cephia D. Toomer
(74) *Attorney, Agent, or Firm*—John H. Thomas P.C.

(57) ABSTRACT

A combustion additive is used for protecting and improving the operation of diesel fuel combustion systems. The additive contains one or more iron-containing compounds. The additive can be added to the fuel prior to introduction into a combustion chamber or to the exhaust after the combustion chamber. The additive will then enhance the operation of diesel fuel combustions systems by improving, for example, exhaust aftertreatment performance.

12 Claims, No Drawings

METHOD AND FUEL ADDITIVE INCLUDING IRON NAPHTHENATE

FIELD OF THE INVENTION

The present invention relates to a combustion additive and to the use of a combustion additive for protecting and improving the operation of diesel fuel combustion systems. The additive contains one or more iron-containing compounds. The additive can be added to the fuel prior to introduction into a combustion chamber or to the exhaust after the combustion chamber. The additive will then enhance the operation of diesel fuel combustions systems by improving, for example, exhaust aftertreatment performance.

DESCRIPTION OF THE PRIOR ART

Fuel borne metallic additives are useful for a wide variety of combustion equipment requirements such as improving the octane rating, engine deposit control, valve seat wear control, exhaust emissions lowering, and protection of exhaust aftertreatment systems. These additives may be blended in the fuel at the refinery, or they may be carried on-board as a concentrate that is dosed into the fuel stream on demand.

Metallic additive concentrates carried on-board a vehicle are used in maintaining the durability of diesel particulate trap filters (DPFs) by lowering the light off point of the particulate. By lowering the light off point, regeneration of the trap at lower exhaust temperatures is obtained. This is a useful feature, because diesel exhaust seldom achieves the high temperatures necessary for a thermal light off of the trap (over 450° C.). As a result, the particulate loading becomes so high that an increase in back pressure impedes the proper operation of the engine. Further, the subsequent light off is so vigorous that the resulting heat sinters and/or melts the catalyst that is a part of the DPF. On-board dosing of metallic additives has been found to reduce back pressure and sintering by enabling more frequent trap regenerations at relatively lower exhaust temperatures.

Iron is one metal found in metallic additives for use with DPFs. The most common organometallic form used is ferrocene. However, it has been found that ferrocene as an iron source is not always advantageous, especially as an additive concentrate, because of its limited solubility in a wide variety of solvents.

DETAILED DESCRIPTION

The additives and the methods of the present invention are based on the use of iron-containing compounds, and specifically iron-containing compounds including iron naphthenate. The iron in the additive promotes the oxidation of carbon particulate matter that is a combustion by product. Upon introduction into the exhaust stream, the iron comes into contact with the carbon fraction of the particulate, accelerates carbon oxidation reactions, and aids in after treatment system regeneration. By aiding in after treatment system regeneration, the iron-containing additives prevents unacceptable exhaust back-pressure increase that would otherwise result from high particulate loading in the after treatment system such as a diesel particulate trap filter (DPF). The iron-containing compound further improves the durability of the DPF by limiting the exposure of the DPF structure to damaging high exotherms that would result from a high particulate loaded DPF.

In one embodiment, a combustion additive comprises iron naphthenate and a hydrocarbonaceous solvent. The additive has a flash point greater than about 55° C. The iron concentration in the additive in one embodiment is greater than 15 g/L.

In another alternative, a method of reducing engine back pressure resulting from particulate loading on an exhaust aftertreatment system comprises several steps. Those steps include providing a combustion engine having an exhaust aftertreatment system, combusting a fuel in the engine to form combustion exhaust, and adding an iron-containing compound to the combustion exhaust wherein the iron-containing compound comprises iron-naphthenate. The iron-containing compound may be added to the combustion exhaust by addition of the iron-containing compound to the fuel prior to combustion of the fuel in the engine or to the exhaust after combustion of the fuel in the engine.

A further alternative method of enhancing the operation of a diesel particulate filter operates in a similar fashion. The steps of this method including providing a combustion engine having a diesel particulate filter, combusting a diesel fuel in the engine to form combustion exhaust, and adding a iron-containing compound to the combustion exhaust, wherein the iron-containing compound comprises iron naphthenate.

In one example, metallic additive concentrates are expected to be stored on-board vehicles in special containers for over 50,000 miles of a vehicle life. Accordingly, the on-board containers must contain enough of the active metal to last the required period of operation. Further, the additive concentrates must be stable during extreme conditions of vehicle performance. The limited solubility in diesel fuel of ferrocene as an iron source effectively prevents it from being used as an on-board additive concentrate.

Iron naphthenate has been found to be a suitable iron-containing compound for use in connection with on-board containers of metallic additive concentrates. Specifically, iron naphthenate in connection with a hydrocarbonaceous solvent has been found to be effective.

The combustion additive comprising iron naphthenate may, in one embodiment, have an iron concentration greater than about 15 g/L. In an alternative example, the iron concentration is greater than about 22 g/L. In one example, the iron concentration in the additive is approximately 23.6 g/L. In the example of the additive having a concentration of approximately 23.6 g/L of iron, the amount of iron naphthenate that is used can be, for example, 196.66 g/L of solvent. The iron concentration in the additive can be as high as 125.0 g/L, or higher, in some examples.

The solvent that is useful herein in connection with the iron naphthenate additive comprises a hydrocarbonaceous solvent. In one example, this solvent is an aromatic solvent having a flash point of about 150° F. A particular solvent that is acceptable is commercially available as ShellSol AB (ShellSol A150). Other solvents having a flash point greater than about 130° F. are acceptable. The solvent may have a boiling range of about 150-400° C. In one example, the boiling range of the solvent is in the range of 170-300° C.

In the example discussed where the additive is stored in an on-board special container, the additive is adapted to be added to the fuel before combustion in the combustion engine. Alternatively, the iron-containing compound may be added into the exhaust stream that results from the combustion of fuel in a combustion engine system.

Thus, the present invention also provides a method wherein the fuel is a diesel fuel comprising at least one cold flow improver or antiwaxing additive and further comprising an ignition improver selected from the group consisting of nitrated compounds and peroxides, and wherein the combustion additive has an iron concentration of 0.3 to 125.0 g/L, viscosity at 40° C. of no more than 1.70 $mm^2/s$ and a cloud point less than −40° C.

In another embodiment is provided a method wherein the fuel is a diesel fuel comprising a cold flow improver or antiwaxing additive, and the combustion additive has an iron concentration of 22.3 to 25.0 g/L, viscosity at 40° C. of no more than 1.70 $mm^2/s$, a boiling range of solvent of 170-300° C., and a cloud point less than −40° C.

Yet another example provides a method wherein the fuel is a diesel fuel comprising at least one ignition improver selected from the group consisting of nitrated compounds and peroxides, and wherein the combustion additive has an iron concentration of 22.3 to 25.0 g/L, viscosity at 40° C. of no more than 1.70 $mm^2/s$, a boiling range of solvent of 170-300° C., and a cloud point less than −40° C.

Yet another embodiment herein provides a method wherein the fuel is a diesel fuel comprising a cold flow improver or antiwaxing additive, and further comprising an ignition improver selected from the group consisting of nitrated compounds and peroxides, and wherein the combustion additive has an iron concentration of 22.3 to 25.0 g/L, viscosity at 40° C. of no more than 1.70 $mm^2/s$, a boiling range of solvent of 170-300° C., and a cloud point less than −40° C.

The treat rate of iron (iron naphthenate) may vary depending on the needs and requirements of a given system. The treat rate must be enough to be effective to prevent unacceptable exhaust back pressure resulting from high particulate loading of a diesel particulate filter. The treat rate must be sufficient to improve the durability of the DPF by limiting the exposure of that structure to damaging high exotherms that result from a high particulate loaded DPF.

The fuel combustion systems that may benefit from the present invention include all combustion engines that burn diesel fuels. By "combustion system" herein is meant any and all internal and external combustion devices, machines, engines, turbine engines, boilers, incinerators, evaporative burners, stationary burners and the like which can combust or in which can be combusted a diesel fuel.

Diesel fuel combustion systems are being engineered to incorporate one or more new components which may result in the accumulation of new, high mass levels of particulate loading in engine aftertreatment systems. New diesel fuel combustion system components include, but are not limited to, the following: exhaust gas recirculation systems, either hot or cooled; variable-scroll turbochargers/variable geometry turbochargers; common-rail fuel injection systems; hydraulically-activated electronically-controlled unit injectors; turbocharged and after cooled combustion air systems; elevated mean fuel injection pressure and injection rate shaping capable systems; electronic engine control systems for combustion air, fuel and exhaust; variable valve actuation systems; homogenous charge compression ignition systems; and low friction coatings (e.g., carbon-based and PTFE) on engine surfaces.

When formulating additives to be used in the methods and additives of the present invention, the iron-containing compounds are employed in amounts sufficient to enhance the operation of diesel fuel combustion systems like those described herein. The amount or concentration of the additive may be selected based on the specific components incorporated into the particular combustion system and how they affect, for instance, the amount of soot that they cause to be loaded into aftertreatment systems. The amount or concentration of the additive may also be selected based on the concentration of sulfur in the diesel fuel.

Reference is also made throughout of the term "enhanced" in the context of operation of exhaust aftertreatment systems such as diesel particulate filters. The term "enhanced" means an improvement in the operation of the aftertreatment systems relative to the operation of a similar system that does not have an iron compound combusted in it. "Enhanced" operation includes, but is not limited to, increased diesel particulate filter life and reduced fuel consumption.

EXAMPLE

One particular vehicle manufacturer has generated a list of performance specifications for a particular iron-containing additive. This is an additive concentrate that will be stored in an on-board container. Table 1 illustrates an example of a specification with the attributes of an iron-containing additive. In this example, iron naphthenate was added at a concentration of 196.66 g/L of ShellSol AB.

TABLE 1

| Property | Units | Range | Example |
|---|---|---|---|
| Iron Concentration | g/L | 15-50 | 23.6 |
| Viscosity range @ 40° C. | $mm^2/s$ | 1.70 max. | 1.38 |
| Boiling Range of Solvent | ° C. | 150-400 | 179-214 |
| Flash Point | ° C. | >55 | 62 |
| Cloud Point | ° C. | <−40 | <−40 |
| Compatible and liquid Range of −40° C. to 40° C. | | Clear liquid | Compatible & Liquid |
| Total Sediment | mg/kg | <24 | Trace |

The specifications for the ShellSol AB include the following:

TABLE 2

| Property | Units | | Typical Results |
|---|---|---|---|
| Average Molecular wt | g/mol | | 131-133 |
| Viscosity @ 25° C. | $mm^2/s$ | | 1.2 |
| Density @ 15 ° C. | g/ml | | 0.880-0.910 |
| Boiling Range | ° C. | | 179-214 |
| Flash Point | ° C. | | 62–64 |
| Chemical Composition of Solvent | | Mesitylene | 2% |
| | | 1,2,3-Trimethylbenzene | 15% |
| | | Naphthalene | 5.8% |
| | | Other Hydrocarbons and Aromatics | 75-78% |

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A combustion additive comprising iron naphthenate and a hydrocarbonaceous solvent, the additive having a flash point greater than about 55° C. and a cloud point less than −40° C.; and a viscosity at 40° C. of no more than 1.70 $mm^2/s$.

2. The combustion additive described in claim 1, wherein the iron concentration in the additive is greater than 15 g/L.

3. The combustion additive described in claim 2, wherein the iron concentration in the additive is greater than 22 g/L.

4. The combustion additive described in claim 2, wherein the iron concentration in the additive is approximately 23.6 g/L.

5. The combustion additive described in claim 1, wherein the flash point of the solvent is about 150° F.

6. The combustion additive described in claim 1, wherein the solvent is an aromatic solvent.

7. The combustion additive described in claim 1, wherein the additive is adapted to be added to a diesel fuel.

8. The combustion additive described in claim 1, wherein the solvent has a boiling range of 150-300° C.

9. The combustion additive described in claim 1, wherein the solvent has an average molecular weight of 131-133 g/L.

10. The combustion additive described in claim 9, further wherein the solvent has a viscosity at 25° C. of 1.2 $mm^2/s$.

11. The combustion additive described in claim 9, further wherein the solvent has a density at 15° C. of 0.880-0.910 g/ml.

12. The combustion additive described in claim 1, wherein the additive has an iron concentration of 22.3 to 25.0 g/L, viscosity at 40° C. of no more than 1.70 $mm^2/s$, and a boiling range of solvent of 170-300° C.

* * * * *